US012577949B2

(12) United States Patent
Welte et al.

(10) Patent No.: US 12,577,949 B2
(45) Date of Patent: Mar. 17, 2026

(54) VANE PUMP FEATURING FLUID LUBRICATION FOR AN IMPELLER

(71) Applicant: Schwäbische Hüttenwerke Automotive GmbH, Aalen (DE)

(72) Inventors: Claus Welte, Aulendorf (DE); Lothar Preisler, Bad Schussenried (DE); Michael Schwarz, Mittelbiberach (DE)

(73) Assignee: SCHWÄBISCHE HÜTTENWERKE AUTOMOTIVE GMBH, Aalen (DE)

( * ) Notice: Subject to any disclaimer, the term of this patent is extended or adjusted under 35 U.S.C. 154(b) by 18 days.

(21) Appl. No.: 18/737,957

(22) Filed: Jun. 8, 2024

(65) Prior Publication Data

US 2024/0410364 A1 Dec. 12, 2024

(30) Foreign Application Priority Data

Jun. 9, 2023 (DE) ..... 10 2023 115165.7

(51) Int. Cl.
*F04C 2/32* (2006.01)
*F04C 2/324* (2006.01)
*F04C 15/00* (2006.01)

(52) U.S. Cl.
CPC ..... *F04C 2/324* (2013.01); *F04C 15/0088* (2013.01)

(58) Field of Classification Search
CPC ..... F04C 2/324; F04C 2/344; F04C 15/0088; F04C 18/3445; F04C 27/001; F04C 29/02; F04C 29/021; F01C 21/0863; F01C 21/108
See application file for complete search history.

(56) References Cited

U.S. PATENT DOCUMENTS 6,068,461 A * 5/2000 Haga ..... F04C 15/0049 418/259
9,828,992 B2 * 11/2017 Stambaugh, Sr. .. F01C 21/0809
2009/0180913 A1 * 7/2009 Kimberlin ..... F04C 2/3446 418/261

(Continued)

FOREIGN PATENT DOCUMENTS

DE 102013105436 A1 12/2014
DE 102019121958 A1 2/2021
EP 3263835 A1 1/2018

OTHER PUBLICATIONS

German Search Report w/ translation mailed on Mar. 13, 2024, by the German Patent Office in Int'l App. No. 10 2023 115 165.7. (14 pages).

*Primary Examiner* — Dapinder Singh
(74) *Attorney, Agent, or Firm* — Buchanan Ingersoll & Rooney PC

(57) ABSTRACT

A vane pump includes: a housing with a first end-facing wall and a second end-facing wall which delineate a delivery chamber on one end-facing side each, and with a circumferential wall which extends around the delivery chamber; a rotor which can be rotated about a rotational axis in the delivery chamber and which forms a first axial gap with the first end-facing wall and a second axial gap with the second end-facing wall; multiple vanes which can be moved back and forth in guide slots of the rotor, wherein the guide slots have sub-vane regions which are connected to the high-pressure side of the delivery chamber in order to apply pressure to the underside of the respective vanes; and a collecting structure for collecting fluid via the first axial gap.

20 Claims, 5 Drawing Sheets

(56) References Cited

U.S. PATENT DOCUMENTS

| | | | | |
|---|---|---|---|---|
| 2015/0240807 | A1* | 8/2015 | Reiber | F01C 21/10 418/22 |
| 2018/0003176 | A1 | 1/2018 | Welte | |
| 2018/0306184 | A1* | 10/2018 | Nakamura | F01C 21/0863 |
| 2020/0340474 | A1* | 10/2020 | Iser | F04C 14/22 |

* cited by examiner

VANE PUMP FEATURING FLUID LUBRICATION FOR AN IMPELLER

CROSS REFERENCE TO RELATED APPLICATION

This application claims priority to German Patent Application No. 10 2023 115 165.7, filed Jun. 9, 2023, the contents of such application being incorporated by reference herein.

FIELD OF THE INVENTION

The invention relates to a vane pump for supplying an assembly with a fluid. The assembly can in particular be a drive motor or a transmission, for example an automatic transmission, or a battery system of a motor vehicle, and the fluid can for example be lubricating oil and/or cooling liquid and/or transmission oil. In particular, the invention relates to lubricating a rotor of the vane pump in an axial gap adjoining the rotor on the end-facing side.

BACKGROUND OF THE INVENTION

Vane pumps have a rotating impeller comprising a rotor and vanes which can be moved back and forth in order to form delivery cells which periodically increase in size in a low-pressure region of the vane pump and then decrease in size again in a high-pressure region of the vane pump as the impeller rotates, in order to deliver fluid from the low-pressure region to the high-pressure region and expel it at an increased pressure in the high-pressure region. The two end-facing sides of the rotor each form an axial sealing gap with a housing of the vane pump, wherein leakage fluid flows through the axial sealing gap due to the pressure differences across the sealing gap. The leakage fluid reduces the friction between the surfaces which axially delineate the sealing gap and which can be moved relative to each other. On the one hand, however, the leakage is associated with a reduction in the effectiveness of the vane pump.

SUMMARY OF THE INVENTION

An aspect of the invention aims to improve lubrication on the end-facing side of a rotor of a vane pump by means of the fluid delivered by the vane pump.

The desired aim is lubrication which is associated with little loss in effectiveness.

A vane pump such as the invention relates to comprises a pump housing having a first end-facing wall, a second end-facing wall and a circumferential wall. The first end-facing wall and second end-facing wall of the housing delineate a delivery chamber of the vane pump on one end-facing side each, while the circumferential wall of the housing extends around the delivery chamber. The delivery chamber has a low-pressure side comprising an inlet for a fluid to be delivered and a high-pressure side comprising an outlet for the fluid. A rotor of the vane pump is arranged in the delivery chamber such that it can be rotated about a rotational axis. The rotor forms an impeller of the vane pump together with multiple vanes which can be moved back and forth in guide slots of the rotor. The vanes delineate delivery cells which periodically increase in size on the low-pressure side of the delivery chamber and decrease in size when passing through the high-pressure side as the impeller rotates, in order to deliver fluid from the inlet to the outlet and expel it at an increased pressure in the high-pressure region.

The vane pump itself has a low-pressure side and a high-pressure side. The low-pressure side of the vane pump comprises the low-pressure side of the delivery chamber and extends from its inlet, initially up to a pump inlet of the pump housing, and also comprises a region upstream of the pump inlet which guides the fluid up to for example a fluid reservoir from which the fluid can be delivered. The high-pressure side of the vane pump comprises the high-pressure side of the delivery chamber, and the entire region downstream of the delivery chamber which guides the fluid up to a pump outlet of the pump housing, and also comprises a region downstream of the pump outlet which guides the fluid up to for example an assembly to be supplied with the fluid.

The guide slots each have a radially inner sub-vane region which is connected to the high-pressure side of the delivery chamber at least when the vane being guided in the respective slot is passing through the high-pressure side of the delivery chamber, in order to apply pressure to the underside of the respective vane and, in particular in the lower rotational speed range of the rotor, press it towards an inner circumference of a stroke structure which peripherally surrounds the vanes. The circumferential wall of the housing can directly form this stroke structure and thus directly surround the delivery chamber. Alternatively, the stroke structure can be provided in addition to the circumferential wall of the housing, for example in the form of a stroke structure which can be moved back and forth in order to adjust the specific delivery volume of the vane pump.

The rotor has a first end-facing side and a second end-facing side. The first end-facing side of the rotor forms a first axial gap with the first end-facing wall of the housing. The second end-facing side of the rotor forms a second axial gap with the second end-facing wall of the housing. When the vane pump is in operation, the pressure differences in the pump housing mean that a leakage flow of the fluid delivered by the vane pump flows, subject to losses, from the high-pressure side of the vane pump towards the low-pressure side of the vane pump via the axial gaps. On the one hand, the leakage flow is associated with a loss in effectiveness; conversely, however, the leakage fluid lubricates the surfaces moved relative to each other in the respective axial gap, i.e. the end-facing surfaces on the two end-facing sides of the rotor and the axially opposite end-facing surfaces of the end-facing walls of the housing.

If the rotor is axially mounted in a suspended manner in the pump housing, the end-facing surfaces of the rotor and the end-facing surfaces of the end-facing walls of the housing, which are opposite each other across the axial gaps, form an axial slide bearing, and the leakage fluid in the axial gaps serves as a lubricant and suspension means for the sliding surfaces of the rotor and pump housing which can be rotated relative to each other. In such embodiments, the rotor can be axially movable relative to the pump housing and relative to a drive shaft for the rotor. The rotor can however in particular be connected axially fixed to the drive shaft and mounted such that it can be axially moved together with the drive shaft relative to the pump housing. The rotor can however in principle be connected not only axially fixed but also non-rotationally to a drive shaft, and the drive shaft can be axially fixed in the pump housing. In such embodiments, the leakage fluid in the axial gaps serves lubrication purposes only. Irrespective of how the rotor and/or a drive shaft for the rotor are mounted, the leakage fluid can advantageously form a lubricating film in the respective axial gap, which mutually separates the end-facing surfaces which are moved relative to each other. If, as is preferred, the rotor is axially mounted in a suspended manner, then it can be mounted in such a way that the fluid in the axial gap supports the rotor in the axial direction.

In the first axial gap, a collecting structure which extends around the rotational axis serves to collect fluid which enters the collecting structure via the first axial gap and accumulates in the collecting structure. The collecting structure consists of one or more recesses formed on the first end-facing wall of the housing and/or on the first end-facing side of the rotor, radially between the rotational axis of the rotor and the sub-vane regions.

In accordance with the invention, the first axial gap forms an outer sealing gap, radially between the sub-vane regions and the collecting structure, which continuously encircles the rotational axis of the rotor and thus also the collecting structure without interruption. The outer sealing gap can radially adjoin the collecting structure, i.e. can directly adjoin the collecting structure on the radially outer side and delineate the collecting structure on the radially outer side. It can radially adjoin the sub-vane regions or one or more supply pockets for the sub-vane regions, i.e. can extend directly up to the sub-vane regions or the respective supply pocket and delineate them on the radially inner side. In its capacity as a "sealing gap", the outer sealing gap separates the sub-vane regions from the collecting structure and, where the sub-vane regions are connected to the high-pressure side of the vane pump, also from the low-pressure side of the vane pump. Fluid can flow from the sub-vane regions, pressurised when the pump is in operation, towards the collecting structure only due to leakage, i.e. in the form of leakage fluid. Because the sealing gap which is an outer sealing gap in relation to the collecting structure fluidically isolates the collecting structure to such an extent that fluid can only enter the collecting structure as leakage, fluid losses via the first axial gap and the associated losses in the effectiveness of the vane pump are reduced.

In preferred embodiments, the first axial gap also forms an inner sealing gap, circumferentially and continuously around the rotational axis without interruption, which the collecting structure surrounds. The inner sealing gap can radially adjoin the collecting structure, i.e. can directly adjoin the collecting structure on the radially inner side and delineate the collecting structure on the radially inner side. If the rotor has a central opening for a drive shaft, for example in the form of a passage or blind cavity, the inner sealing gap can extend radially inwards up to the central opening.

In order to form the outer sealing gap, the first end-facing wall of the housing can have a radially outer sealing surface, and the first end-facing side of the rotor can have a radially outer sealing surface. The outer sealing surface of the end-facing wall and the outer sealing surface of the rotor are uninterrupted, continuously circumferential end-facing surfaces which are axially opposite each other and together form the outer sealing gap. In embodiments comprising an inner sealing gap, the first end-facing wall of the housing can have a radially inner sealing surface, and the first end-facing side of the rotor can have a radially inner sealing surface. The inner sealing surface of the end-facing wall and the inner sealing surface of the rotor are end-facing surfaces which are each continuously circumferential without interruption and axially opposite each other, in order to form the inner sealing gap. The sealing surfaces of the first end-facing wall of the housing can in particular extend in a common plane. The sealing surfaces of the rotor can likewise extend in a common plane. Conversely, however, embodiments are also possible in which the outer sealing gap is formed by sealing surfaces of the first end-facing wall of the housing which are axially offset with respect to each other and sealing surfaces of the rotor which are correspondingly axially offset. In embodiments comprising an inner sealing gap, the same applies analogously. In embodiments comprising an inner sealing gap, the inner sealing gap can be axially offset with respect to the outer sealing gap. Embodiments in which all of the sealing surfaces of the first end-facing wall of the housing and all of the sealing surfaces of the rotor respectively extend in a common plane are however preferred.

The outer sealing gap and/or the inner sealing gap, if provided, can (each) in particular be embodied such that fluid in the respective sealing gap can only flow omnidirectionally into or out of the collecting structure. In this context, "omnidirectionally" means that there is no macroscopic connecting channel extending on the first end-facing wall of the housing and on the first end-facing side of the rotor, through which fluid can flow up to and into the collecting structure or out of the collecting structure in a direction corresponding to the profile of the channel. There is thus no connecting channel to reduce the flow resistance of the outer sealing gap and/or inner sealing gap, if an inner sealing gap is provided, and fluidically connect the collecting structure to the high-pressure side and/or low-pressure side of the pump in this way.

The sealing surfaces which together form the respective sealing gap are macroscopically smooth continuously and circumferentially and axially opposite each other at a distance which is small enough that only leakage can occur in the sealing gap. The respective sealing gap is correspondingly configured in terms of the gap width and/or roughness of the sealing surfaces. Conversely, one or both of the sealing surfaces which form the outer and/or inner sealing gap can contain one or more pockets, as long as the respective sealing gap is sufficiently wide in the radial direction, i.e. has a sufficiently wide sealing section in the radial direction, to perform its sealing function, i.e. to fluidically separate the collecting structure from the high-pressure side of the vane pump and, in developments, also from the low-pressure side of the vane pump and to only allow a leakage flow. In advantageous embodiments, the sealing section formed by the outer sealing gap is continuously and circumferentially at least 1 mm or at least 1.5 mm or at least 2 mm wide in the radial direction. In advantageous embodiments, the inner sealing gap (if provided) likewise forms a radial sealing section which is continuously and circumferentially at least 1 mm or at least 1.5 mm or at least 2 mm wide in the radial direction.

Axial gap widths of up to a maximum of 0.05 mm or a maximum of 0.04 mm or even better a maximum of 0.03 mm are advantageous. Conversely, the gap width has minimum limits due to component and/or assembly tolerances and/or component distortions which can occur during operation due to changes in pressure and temperature. The axial gap width is expediently at least 0.01 mm. These values apply in particular to the sizes of pumps which are common in vehicle manufacturing, such as lubricant pumps, transmission pumps and coolant pumps.

The one or more sealing surfaces of the first end-facing wall of the housing which delineate(s) the outer sealing gap, and preferably also the one or more sealing surfaces of the first end-facing wall of the housing which delineate(s) the inner sealing gap, if an inner sealing gap is provided, can (each) in particular be a lapped sealing surface.

In advantageous embodiments, the one or more sealing surfaces of the first end-facing wall of the housing which delineate(s) the outer sealing gap, and preferably also the one or more sealing surfaces of the first end-facing wall of the housing which delineate(s) the inner sealing gap, if an inner sealing gap is provided, can (each) have a surface quality according to one or more of the following characteristics:

average surface roughness of Rz5 or Rz4 or Rz3 relative material ratio of Rmr(1.0)>65% (c0 5%) or Rmr (1.0)>75% (c0 5%)

reduced peak height of Rpk<0.5 or Rpk<0.4 core surface roughness of Rk<2.0 or Rk<1.5

In advantageous embodiments, the one or more sealing surfaces of the rotor which delineate(s) the outer sealing gap, and preferably also the one or more sealing surfaces of the rotor which delineate(s) the inner sealing gap, if an inner sealing gap is provided, can (each) have an average roughness of Rz7 or Rz6.3 or less.

The collecting structure can have multiple recesses which are spaced apart from each other in the circumferential direction around the rotational axis of the rotor and/or radially on the first end-facing wall of the housing and/or the first end-facing side of the rotor. The collecting structure can then for example have multiple annular recesses which each extend around the rotational axis and are radially spaced apart from each other. If the collecting structure comprises multiple annular recesses, they can in particular be arranged concentrically with respect to each other. The annular recesses can continuously encircle the rotational axis. Alternatively, however, one or more or each of the annular recesses can also be formed as an annular segment only. If the collecting structure comprises multiple recesses, they are advantageously fluidically separated from each other.

The collecting structure can in particular continuously encircle the rotational axis of the rotor and for example comprise a continuously circumferential annular groove, which also includes the preferred embodiment in which the recess structure is a continuously circumferential annular groove, wherein "continuously circumferential" means that the recess in question extends 360° around the rotational axis and is self-contained. In embodiments in which the collecting structure comprises multiple continuously circumferential annular grooves or, as is preferred, is formed as only one continuously circumferential annular groove, the respective annular groove can in particular be a blind groove.

If the collecting structure is formed by one or more annular or annular segment-shaped recesses, preferably one or more continuously circumferential blind grooves, the respective recess can have a round, V-shaped or U-shaped profile, wherein a round or V-shaped profile is preferred because the ratio of the free surface to the volume of fluid accumulating in the recess is greater than for a U-shaped profile. If the collecting structure comprises multiple recesses which are separate from each other and for example pocket-shaped, this advantageously likewise applies to each of these recesses.

The collecting structure can also be formed by multiple pocket-shaped recesses which are spaced apart from each other in the circumferential direction. The pocket-shaped recesses can for example be in the manner of a blind hole or shaped like a hollow. Advantageously, the pocket-shaped recesses collectively form a ring-like collecting structure around the rotational axis.

The vane pump can comprise a drive shaft which is mounted such that it can be rotated about the rotational axis and to which the rotor is connected for transmitting torque. The rotor can in particular be arranged coaxially with respect to the drive shaft. The rotor can advantageously be non-rotationally connected to the drive shaft. The drive shaft can protrude through the rotor, and the collecting structure can extend around the drive shaft. In embodiments comprising an inner sealing gap, the inner sealing gap can extend around the drive shaft, radially between the drive shaft and the collecting structure, continuously and circumferentially without interruption. In such embodiments, the inner sealing gap can adjoin the drive shaft on the radially inner side and the collecting structure on the radially outer side. In advantageous embodiments, the drive shaft protrudes into the first end-facing wall of the housing. If the drive shaft protrudes into the first end-facing wall of the housing, it can be rotatably supported on the first end-facing wall of the housing. A rotary bearing, expediently a rotary slide bearing, for the drive shaft can then be formed in a shaft receptacle of the first end-facing wall of the housing. If the drive shaft protrudes into the second end-facing wall of the housing, a rotary bearing (expediently a rotary slide bearing) for the drive shaft can be formed in a shaft receptacle of the second end-facing wall of the housing. Radially supporting the drive shaft in both a shaft receptacle of the first end-facing wall of the housing and a shaft receptacle of the second end-facing wall of the housing is advantageous for the purpose of rotationally mounting it in a way which is resistance to bending.

The drive shaft can be secured, axially fixed, to the first end-facing wall of the housing and/or the second end-facing wall of the housing, wherein the rotor can be axially mounted in a suspended manner on the drive shaft. More preferably, the rotor is connected axially fixed to the drive shaft, and the arrangement consisting of the drive shaft and the rotor is axially mounted via the rotor and the first and second axial gaps.

The vane pump can be a single-flow pump or a multi-flow pump. In multi-flow embodiments, the vane pump can in particular be a multi-circuit pump, i.e. it can have multiple flows which are separated from each other on both the low-pressure side and the high-pressure side. In multi-circuit embodiments, the vane pump can thus have a first flow comprising the aforementioned inlet and outlet and, following the first flow in the rotational direction of the rotor, a second flow comprising another inlet and another outlet, such that when the rotor is rotated, a portion of the fluid is delivered in the first flow and another portion of the fluid is delivered in the second flow. In multi-circuit embodiments, the vane pump can be configured such that it can provide different pressures at the outlets of the multiple flows. Fluidically separating the collecting structure from the sub-vane regions is advantageous in multi-circuit embodiments of the vane pump in particular.

The sub-vane regions can be connected to each other via one or more supply pockets. In single-flow pump embodiments, one supply pocket which is connected to the high-pressure side and another supply pocket which is connected to the low-pressure side can be provided in order to connect the sub-vane regions to one supply pocket when passing through the low-pressure side and to the other supply pocket when passing through the high-pressure side. If two or more supply pockets are provided which are formed separately from each other, however, it is preferable for all of the supply pockets to be connected to the high-pressure side. One or more supply pockets can also be embodied as isolated, blind pockets. In multi-flow and in particular multi-circuit pump embodiments, one or more supply pockets can be respectively provided for each flow, wherein the one or more supply pockets of one flow are advantageously fluidically separated from the one or more supply pockets of the other flow. Each of the flows can then be respectively provided with one supply pocket which is connected to the high-pressure side of the respective flow and one supply pocket which is connected to the low-pressure side of the respective flow. If the respective flow has two or more supply pockets which are formed separately from each other, however, it is preferable for all of the supply pockets of the respective flow to be connected to the high-pressure side of said flow. One or more supply pockets of the respective flow can also be designed as isolated, blind pockets. The one or preferably multiple supply pockets extend around the rotational axis of the rotor and overlap with the sub-vane regions. The outer sealing gap expediently extends, radially between the collecting structure and the one or more supply pockets, continuously around the rotational axis without interruption and fluidically separates the collecting structure from the one or more supply pockets and thus also from the sub-vane regions. The collecting structure can radially adjoin the one or more supply pockets directly.

Features of the invention are also described in the aspects formulated below. The aspects are formulated in the manner of claims and can substitute for them. Features disclosed in the aspects can also supplement and/or qualify the claims, indicate alternatives with respect to individual features and/or broaden the claim features. Bracketed reference signs refer to example embodiments of the invention illustrated below in figures. The reference signs do not restrict the features described in the aspects to their literal sense as such, but do conversely indicate preferred ways of implementing the respective feature.

Aspect 1. A vane pump for supplying an assembly with a fluid, the vane pump comprising:

1.1 a pump housing having a first end-facing wall (1) and a second end-facing wall (2) which delineate a delivery chamber (4) of the vane pump on one end-facing side each, and a circumferential wall (3) which extends around the delivery chamber (4);

1.2 an inlet (5) for the fluid on a low-pressure side of the delivery chamber (4) and an outlet (6) for the fluid on a high-pressure side of the delivery chamber (4);

1.3 a rotor (11) which can be rotated about a rotational axis (R) in the delivery chamber (4) and which forms a first axial gap (1*a*, 1*b*, 11*a*) with the first end-facing wall (1) of the housing on a first end-facing side and a second axial gap with the second end-facing wall (2) of the housing on the other, second end-facing side;

1.4 multiple vanes (12) which can be moved back and forth in guide slots (13) of the rotor (11), wherein the guide slots (13) have radially inner sub-vane regions (14) which are connected to the high-pressure side of the delivery chamber (4) at least when the vanes (12) are passing through the high-pressure side, in order to apply pressure to the underside of the respective vanes (12); and 1.5 a collecting structure (20) which extends around the rotational axis (R) in the first axial gap (1*a*, 1*b*, 11*a*) in order to collect fluid which enters the collecting structure (20) via the first axial gap (1*a*, 1*b*, 11*a*), 1.6 wherein the collecting structure (20) comprises one or more recesses formed on the first end-facing wall (1) of the housing and/or the first end-facing side of the rotor (11), radially between the rotational axis (R) and the sub-vane regions (14), and 1.7 the first axial gap (1*a*, 1*b*, 11*a*) forms an outer sealing gap (1*a*, 11*a*), radially between the sub-vane regions (14) and the collecting structure (20), which continuously encircles the rotational axis (R) without interruption.

Aspect 2. The vane pump according to the preceding aspect, wherein the first axial gap (1*a*, 1*b*, 11*a*) forms an inner sealing gap (1*b*, 11*a*), circumferentially and continuously around the rotational axis (R) without interruption, which the collecting structure (20) surrounds.

Aspect 3. The vane pump according to any one of the preceding aspects, wherein the fluid can only flow omnidirectionally in the outer sealing gap (1*a*, 11*a*) and in the inner sealing gap (1*b*, 11*a*), if provided.

Aspect 4. The vane pump according to any one of the preceding aspects, wherein the collecting structure (20) is a blind groove which preferably encircles the rotational axis (R) continuously.

Aspect 5. The vane pump according to any one of the preceding aspects, wherein the collecting structure (20) is fluidically isolated such that fluid can only enter the collecting structure (20) via leakage and preferably also only exit the collecting structure (20) via leakage.

Aspect 6. The vane pump according to any one of the preceding aspects, wherein the outer sealing gap (1*a*, 11*a*) and/or the inner sealing gap (1*b*, 11*a*), if provided, fluidically separates the collecting structure (20) from the high-pressure side and/or the low-pressure side of the vane pump, such that fluid can only enter and/or exit the collecting structure (20) due to leakage via the respective sealing gap (1*a*, 11*a*; 1*b*, 11*a*).

Aspect 7. The vane pump according to any one of the preceding aspects, wherein fluid can only flow into the collecting structure (20) via the first axial gap (1*a*, 1*b*, 11*a*).

Aspect 8. The vane pump according to any one of the preceding aspects, wherein there is no channel extending on the first end-facing wall (1) of the housing and on the first end-facing side of the rotor (11) which fluidically connects the collecting structure (20) to the high-pressure side of the vane pump.

Aspect 9. The vane pump according to any one of the preceding aspects, wherein there is no channel extending on the first end-facing wall (1) of the housing and on the first end-facing side of the rotor (11) which fluidically connects the collecting structure (20) to the low-pressure side of the vane pump.

Aspect 10. The vane pump according to any one of the preceding aspects, wherein the collecting structure (20) is continuously circumferential and preferably is or comprises an annular groove which continuously encircles the rotational axis (R).

Aspect 11. The vane pump according to any one of the preceding aspects, wherein the collecting structure (20) has multiple recesses which are spaced apart from each other in the circumferential direction around the rotational axis (R) and/or radially on the first end-facing wall (1) of the housing or the first end-facing side of the rotor (11).

Aspect 12. The vane pump according to any one of the preceding aspects, wherein the collecting structure (20) comprises multiple annular recesses which each extend around the rotational axis (R) and are radially spaced apart from each other and for example arranged concentrically with respect to each other.

Aspect 13. The vane pump according to any one of the immediately preceding two aspects, wherein the multiple recesses are fluidically separated from each other.

Aspect 14. The vane pump according to any one of the preceding aspects, wherein the outer sealing gap (1*a*, 11*a*) adjoins the collecting structure (20) on the radially outer side and/or the inner sealing gap (1*b*, 11*a*), if provided, adjoins the collecting structure (20) on the radially inner side.

Aspect 15. The vane pump according to any one of the preceding aspects, wherein the outer sealing gap (1*a*, 11*a*) has an axial width $W_{1a}$ and/or the inner sealing gap (1*b*, 11*a*), if provided, has an axial width $W_{1b}$, the collecting structure (20) has a maximum axial depth T, and one or more of the following relationships is/are met:

$$T \geq 5 \times W_{1a} \text{ or } T \geq 10 \times W_{1a} \text{ or } T \geq 20 \times W_{1a}$$

and/or $$T \geq 5 \times W_{1b} \text{ or } T \geq 10 \times W_{1b} \text{ or } T \geq 20 \times W_{1b}.$$

Aspect 16. The vane pump according to any one of the preceding aspects, wherein the collecting structure (20) has a maximum axial depth T, and one or more of the following relationships is/are met:

$$T > 0.2 \text{ mm or } T \geq 0.3 \text{ mm or } T \geq 0.4 \text{ mm}.$$

Aspect 17. The vane pump according to any one of the preceding aspects, wherein the collecting structure (20) has a maximum radial width $B_{20}$ and a maximum axial depth T, and it holds for the ratio $B_{20}/T$ that $$0.5 \leq B_{20}/T \leq 2.$$

Aspect 18. The vane pump according to any one of the preceding aspects, wherein the outer sealing gap (1*a*, 11*a*) has a radial width $B_{1a}$ and/or the inner sealing gap (1*b*, 11*a*), if provided, has a radial width $B_{1b}$, the collecting structure (20) has a maximum axial depth T, and one or more of the following relationships is/are met:

$$B_{1a} \geq T \text{ or } B_{1a} \geq 2 \times T \text{ or } B_{1a} \geq 3 \times T$$

and/or $$B_{1b} \geq T \text{ or } B_{1b} \geq 2 \times T \text{ or } B_{1b} \geq 3 \times T.$$

Aspect 19. The vane pump according to any one of the preceding aspects, wherein the outer sealing gap (1*a*, 11*a*) has a radial width $B_{1a}$ and/or the inner sealing gap (1*b*, 11*a*), if provided, has a radial width $B_{1b}$, the collecting structure (20) has a maximum radial width $B_{20}$, and one or more of the following relationships is/are met:

$$B_{1a} \geq B_{20} \text{ or } B_{1a} \geq 2 \times B_{20} \text{ or } B_{1a} \geq 3 \times B_{20}$$

and/or $$B_{1b} \geq B_{20} \text{ or } B_{1b} \geq 2 \times B_{20} \text{ or } B_{1b} \geq 3 \times B_{20}.$$

Aspect 20. The vane pump according to any one of the preceding aspects, wherein the outer sealing gap (1*a*, 11*a*) has an axial width $W_{1a}$ and/or the inner sealing gap (1*b*, 11*a*), if provided, has an axial width $W_{1b}$, the collecting structure (20) has a maximum radial width $B_{20}$, and one or more of the following relationships is/are met:

$$B_{20} \geq 5 \times W_{1a} \text{ or } B_{20} \geq 10 \times W_{1a} \text{ or } B_{20} \geq 20 \times W_{1a}$$

and/or $$B_{20} \geq 5 \times W_{1b} \text{ or } B_{20} \geq 10 \times W_{1b} \text{ or } B_{20} \geq 20 \times W_{1b}.$$

Aspect 21. The vane pump according to any one of the preceding aspects, wherein the outer sealing gap (1*a*, 11*a*) has an axial width $W_{1a}$ and/or the inner sealing gap (1*b*, 11*a*), if provided, has an axial width $W_{1b}$, and one or more of the following relationships is/are met:

$$W_{1a} \geq 0.01 \text{ mm},$$

$$W_{1a} \leq 0.05 \text{ mm or } W_{1a} \leq 0.04 \text{ mm or } W_{1a} \leq 0.03 \text{ mm},$$

$$W_{1b} \geq 0.01 \text{ mm},$$

$$W_{1b} \leq 0.05 \text{ mm or } W_{1b} \leq 0.04 \text{ mm or } W_{1b} \leq 0.03 \text{ mm}.$$

Aspect 22. The vane pump according to any one of the preceding aspects, wherein the outer sealing gap (1*a*, 11*a*) has a sealing section having a width $B_{1a}$, as measured in the radial direction, throughout with respect to the collecting structure (20) and/or the inner sealing gap (1*b*, 11*a*), if provided, has a sealing section having a width $B_{1b}$, as measured in the radial direction, throughout with respect to the collecting structure (20), and one or more of the following relationships is/are met:

$$B_{1a} \geq 1 \text{ mm or } B_{1a} \geq 1.5 \text{ mm or } B_{1a} \geq 2 \text{ mm}$$

and/or $$B_{1b} \geq 1 \text{ mm or } B_{1b} \geq 1.5 \text{ mm or } B_{1b} \geq 2 \text{ mm}.$$

Aspect 23. The vane pump according to any one of the preceding aspects, wherein:

the first end-facing wall (1) of the housing has a radially outer sealing surface (1*a*);

the first end-facing side of the rotor (11) has a radially outer sealing surface (11*a*); and the outer sealing surface (1*a*) of the end-facing wall and the outer sealing surface (11*a*) of the rotor continuously encircle the rotational axis (R) without interruption axially opposite each other and form the outer sealing gap (1*a*, 11*a*) which is circumferentially contained over 360° and surrounds and preferably radially adjoins the collecting structure (20).

Aspect 24. The vane pump according to any one of the preceding aspects, wherein:

the first end-facing wall (1) of the housing has a radially inner sealing surface (1*b*);

the first end-facing side of the rotor (11) has a radially inner sealing surface (11*a*); and the inner sealing surface (1*b*) of the end-facing wall and the inner sealing surface (11*a*) of the rotor continuously encircle the rotational axis (R) without interruption axially opposite each other and form the inner sealing gap (1*b*, 11*a*) which is circumferentially contained over 360° and which the collecting structure (20) surrounds and which preferably radially adjoins the collecting structure (20).

Aspect 25. The vane pump according to any one of the preceding aspects, wherein:

the first end-facing wall (1) of the housing has a radially outer sealing surface (1*a*) and a radially inner sealing surface (1*b*);

the first end-facing side of the rotor (11) has a radially outer sealing surface (11*a*) and a radially inner sealing surface (11*a*);

the outer sealing surface (1*a*) of the end-facing wall and the outer sealing surface (11*a*) of the rotor continuously encircle the rotational axis (R) without interruption axially opposite each other and form the outer sealing gap (1*a*, 11*a*) which is circumferentially contained over 360° and surrounds and preferably radially adjoins the collecting structure (20); and the inner sealing surface (1*b*) of the end-facing wall and the inner sealing surface (11*a*) of the rotor continuously encircle the rotational axis (R) without interruption axially opposite each other and form an inner sealing gap (1*b*, 11*a*) which is circumferentially contained over 360° and which the collecting structure (20) surrounds and which preferably radially adjoins the collecting structure (20).

Aspect 26. The vane pump according to any one of the preceding aspects, wherein the respective recess of the collecting structure (20) has a round profile.

Aspect 27. The vane pump according to any one of the preceding aspects, wherein the respective recess of the collecting structure (20) has a profile having a round arc-shaped, for example an elliptical arc-shaped, parabolic arc-shaped or circular arc-shaped central recess region (21).

Aspect 28. The vane pump according to any one of the preceding aspects, wherein the respective recess of the collecting structure (20) has a curved profile cross-section having a radius of curvature which changes sign at a transition (23) from a central recess region (21) to a radially inner side edge and/or at a transition (22) from the central recess region (21) to a radially outer side edge of the respective recess, such that the respective recess of the collecting structure (20) is concavely rounded in the central recess region (21) and convexly rounded towards the respective side edge.

Aspect 29. The vane pump according to any one of Aspects 1 to 25, wherein the respective recess of the collecting structure (20) has a U-shaped or preferably V-shaped profile.

Aspect 30. The vane pump according to any one of the preceding aspects, wherein the profile of the respective recess of the collecting structure (20) is tapered or chamfered radially outwards and/or radially inwards in relation to the rotational axis (R) from a central recess region (21) into the first axial gap (1*a*, 1*b*, 11*a*).

Aspect 31. The vane pump according to any one of the preceding aspects, wherein the rotor (11) is axially mounted in a suspended manner between the first end-facing wall (1) of the housing and the second end-facing wall (2) of the housing.

Aspect 32. The vane pump according to any one of the preceding aspects, comprising a drive shaft (15) which is mounted such that it can be rotated about the rotational axis (R) and to which the rotor (11) is connected in a way which transmits torque and preferably non-rotationally, wherein the collecting structure (20) extends around the drive shaft (15), and the first axial gap (1*a*, 1*b*, 11*a*) forms an inner sealing gap (1*b*, 11*a*) which encircles the drive shaft (15), radially between the rotational axis (R) and the collecting structure (20), continuously without interruption.

Aspect 33. The vane pump according to the preceding aspect, wherein the drive shaft (15) protrudes into the first end-facing wall (1) of the housing, and the inner sealing gap (1*b*, 11*a*) adjoins the drive shaft (15) on the radially inner side and the collecting structure (20) on the radially outer side.

Aspect 34. The vane pump according to any one of the immediately preceding two aspects, wherein the drive shaft (15) protrudes into the first end-facing wall (1) of the housing and/or into the second end-facing wall (2) of the housing and is rotatably supported on the first end-facing wall (1) of the housing and/or on the second end-facing wall (2) of the housing.

Aspect 35. The vane pump according to any one of the immediately preceding three aspects, wherein the rotor (11) is secured, axially fixed, relative to the drive shaft (15).

Aspect 36. The vane pump according to any one of the immediately preceding four aspects, wherein the rotor (11) is axially fixed relative to the drive shaft (15).

Aspect 37. The vane pump according to any one of the preceding aspects, wherein the vane pump has a first flow comprising the inlet (5) and the outlet (6) and, following the first flow in the rotational direction of the rotor (11), a second flow comprising another inlet (7) and another outlet (8), such that when the rotor (11) is rotated, a portion of the fluid is delivered in the first flow and another portion of the fluid is delivered in the second flow.

Aspect 38. The vane pump according to any one of the preceding aspects, wherein one or more supply pockets (5*a*, 6*a*, 7*a*, 8*a*) which open into the first axial gap (1*a*, 1*b*, 11*a*) and are connected to the high-pressure side or the low-pressure side of the vane pump is/are provided on the first end-facing wall (1) of the housing, axially facing the sub-vane regions (14), and the outer sealing gap (1*a*, 11*a*) continuously encircles the rotational axis (R), radially between the collecting structure (20) and the supply pocket(s) (5*a*, 6*a*, 7*a*, 8*a*).

Aspect 39. The vane pump according to the preceding aspect, wherein the outer sealing gap (1*a*, 11*a*) adjoins the collecting structure (20) on the radially inner side and the one or more supply pockets (5*a*, 6*a*, 7*a*, 8*a*) on the radially outer side.

BRIEF DESCRIPTION OF THE DRAWINGS

An example embodiment of the invention is described below on the basis of figures. Features disclosed by the figures, each individually and in any combination of features, advantageously develop the claims, the aspects and the embodiments described above. There is shown:

DETAILED DESCRIPTION OF EXEMPLARY EMBODIMENTS

Figure 1:
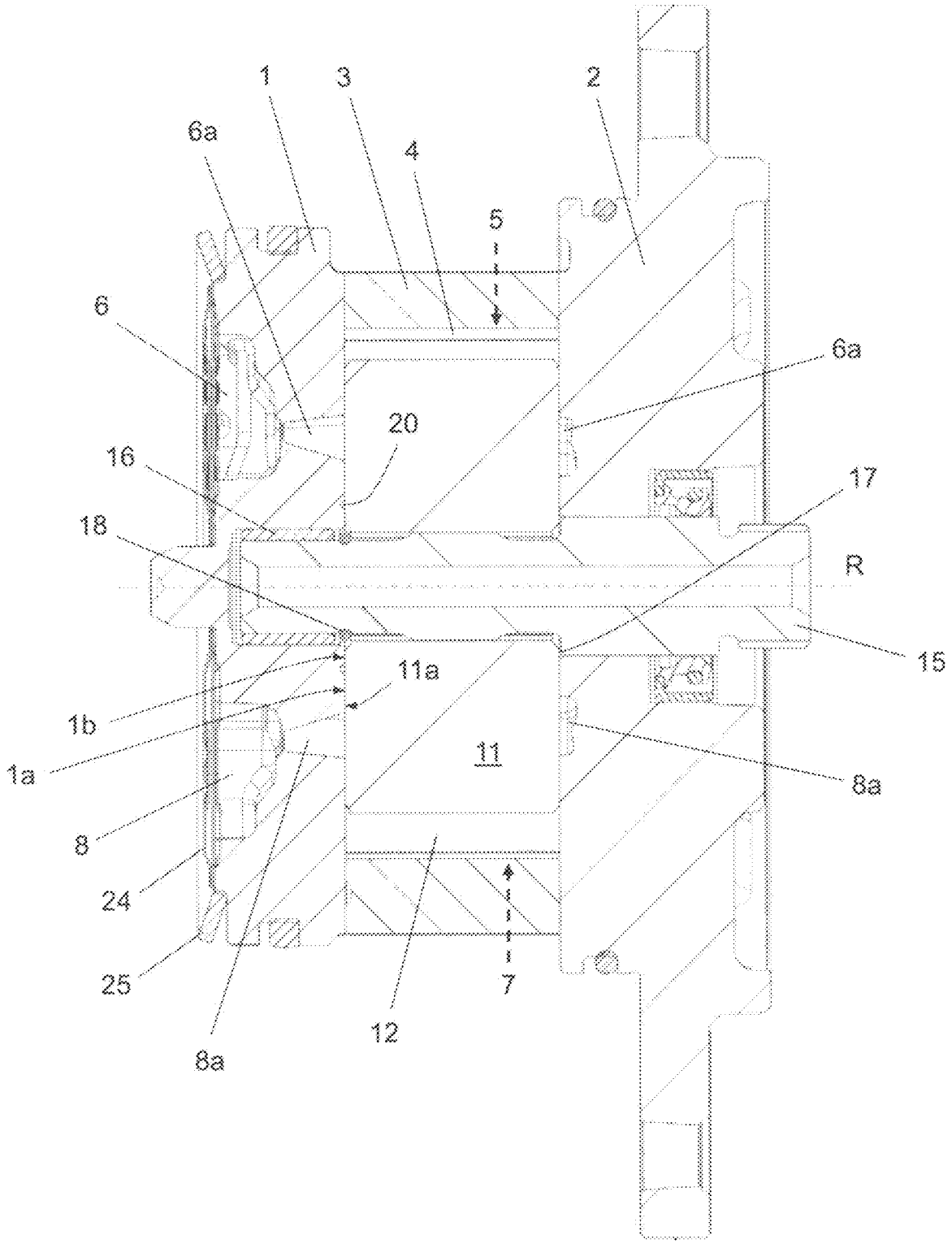
FIG. 1 a vane pump comprising a fluid collecting structure in accordance with the invention, in a longitudinal section.

FIG. 1 shows a vane pump in a longitudinal section. The vane pump has a pump housing featuring a first end-facing wall 1, a second end-facing wall 2 and a circumferential wall 3. The end-facing walls 1 and 2 of the housing axially delineate a delivery chamber 4 on the two end-facing sides. The circumferential wall 3 extends around the delivery chamber 4 and can directly surround the delivery chamber 4, as for instance in the example embodiment. A rotor 11 of the vane pump is accommodated such that it can be rotated about a rotational axis R in the delivery chamber 4.

Figure 2:
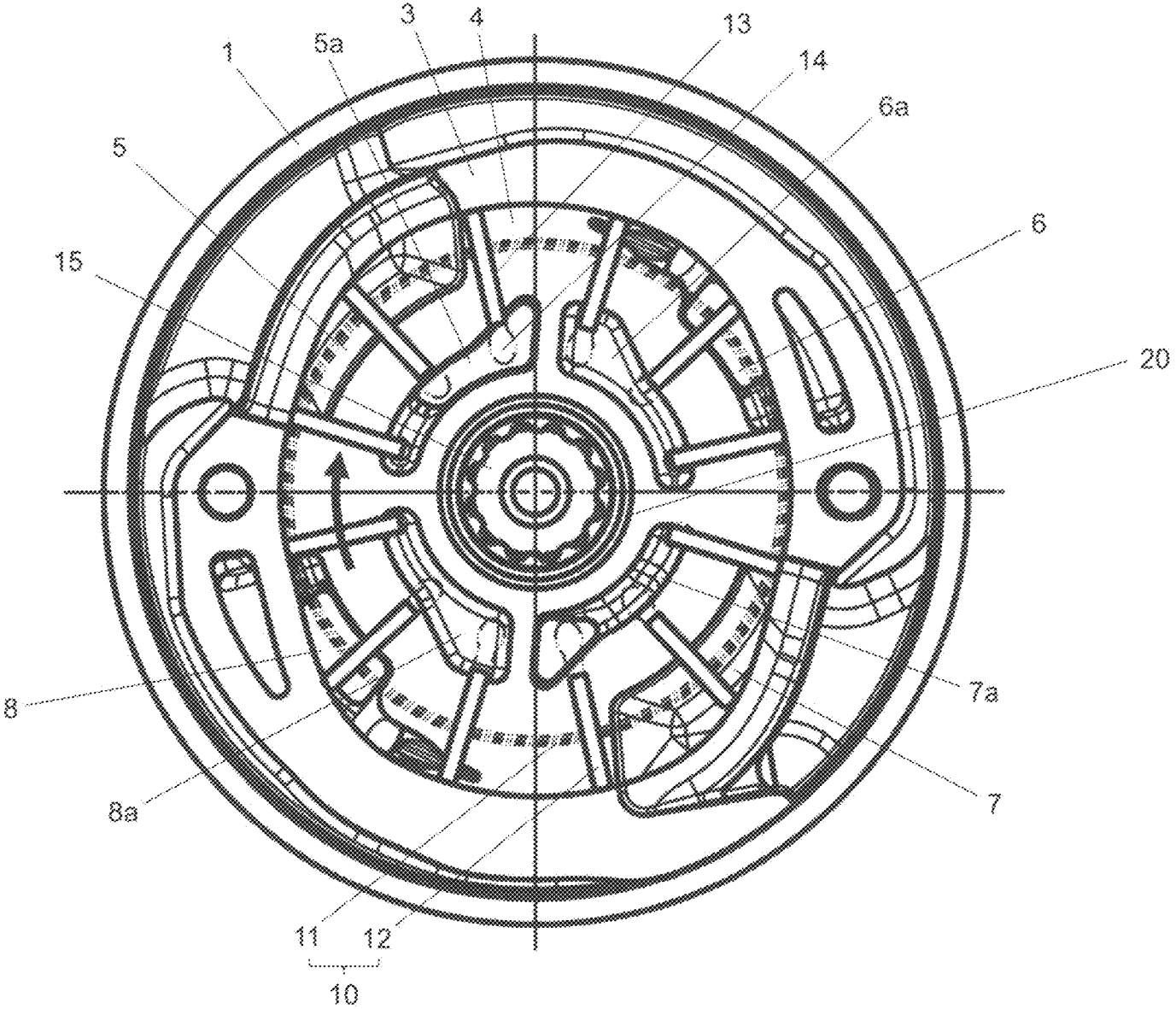
FIG. 2 the vane pump, not yet fully assembled, in a plan view.

FIG. 2 shows the vane pump in a plan view before the end-facing wall 2 of the housing has been assembled, such that there is a clear view into the delivery chamber 4 including the rotor 11 which has already been inserted into the delivery chamber 4. The rotor 11 has guide slots 13 which guide multiple vanes 12 in a distribution around the rotational axis R such that they can be moved radially or at least substantially in the radial direction, as is usual in vane pumps. The rotor 11 and the vanes 12 together form an impeller 10 of the vane pump.

The circumferential wall 3 of the housing serves directly as a stroke structure, and its inner circumference has, for this purpose, a guide surface for the vanes 12. When the rotor 11 is rotated, the vanes 12 are pressed outwards against the guide surface of the circumferential wall 3 of the housing. When the rotor 11 is rotated, the guide surface determines how far the vanes 12 protrude beyond the outer circumference of the rotor 11. The vanes 12 delineate delivery cells, which are formed in the delivery chamber 4, in the circumferential direction. The profile of the guide surface of the circumferential wall 3 of the housing is selected such that when the rotor 10 is rotated in the direction of the rotational direction arrow indicated, for example clockwise, the delivery cells periodically increase in size on a low-pressure side of the delivery chamber 4 and decrease in size again on a high-pressure side of the delivery chamber 4 in order to expel a fluid, which flows into the delivery chamber 4 through an inlet 5 on the low-pressure side of the delivery chamber 4, at an increased pressure as a pressurised fluid on the high-pressure side of the delivery chamber 4 through an outlet 6 on the high-pressure side. In advantageous embodiments, the pump is designed to suction the fluid through the inlet 5, for example against gravity.

The pump is a multi-flow pump (in the embodiment, a dual-flow pump comprising a first flow and a second flow). The flows each have a low-pressure side and a high-pressure side. Accordingly, the delivery chamber 4 has the inlet 5 as a first inlet and the outlet 6 as a first outlet for the first flow and additionally a second inlet 7 and a second outlet 8 for the second flow. When the impeller 10 is rotated in the direction of the rotational direction arrow, the delivery cells pass through the flows consecutively in each revolution. The guide surface of the circumferential wall 3 of the housing is shaped such that the delivery cells increase in size on the low-pressure side of the first flow and decrease in size again on the high-pressure side of the first flow in each revolution, in order to expel fluid, which flows through the inlet 5 into the delivery chamber 4, at an increased pressure as a pressurised fluid on the high-pressure side of the first flow through the outlet 6 on the high-pressure side, and then increase in size again on the low-pressure side of the second flow and decrease in size again on the high-pressure side of the second flow in order to expel fluid, which flows through the inlet 7 into the delivery chamber 4, at an increased pressure as a pressurised fluid on the high-pressure side of the second flow through the outlet 8 on the high-pressure side. The vane pump can be a multi-circuit pump, as is preferred, such that the flows are fluidically separated from each other, wherein the flows can be designed for different pressures and/or delivery volumes.

The inlets 5 and 7 extend along the circumference of the circumferential wall 3 of the housing and on the end-facing sides of the end-facing walls 1 and 2 of the housing which axially face each other. The inlets 5 and 7 are offset in the circumferential direction with respect to the outlets 6 and 8 contained in the section in FIG. 1 and are indicated only schematically in FIG. 1 by dashed arrows. The outlets 6 and 8 extend through the first end-facing wall 1 of the housing and emerge on the outer end-facing side of the first end-facing wall 1 of the housing which faces axially away from the delivery chamber 4 and serves as the high-pressure connecting side of the vane pump. In order to seal the outlets 6 and 8 off from each other, the vane pump comprises an axial gasket 24 (FIG. 1) which is arranged on the outer end-facing side of the first end-facing wall 1 of the housing.

The radially inner ends of the vane slots 13 each form a sub-vane region 14 to which fluid from the high-pressure side of the respective flow is applied when the impeller 10 is rotated. For supplying the sub-vane regions 14, a supply pocket 5*a* and, following it in the rotational direction, a supply pocket 6*a* are formed in the rotational angular region of the first flow, and a supply pocket 7*a* and, following it in the rotational direction, a supply pocket 8*a* are formed in the rotational angular region of the second flow. The supply pockets 5*a* to 8*a* are formed separately from each other, each in the shape of a pocket on the end-facing side of the end-facing wall 1. The supply pocket 5*a* is connected to the outlet 6 of the first flow via a channel, and the supply pocket 7*a* is connected to the outlet 8 of the second flow via another channel. When the impeller 10 is rotated, the sub-vane regions 14 consecutively overlap with the supply pockets 5*a*, 6*a*, 7*a* and 8*a*. As they pass over the supply pockets 5*a* and 7*a*, the latter are exposed to the pressure of the high-pressure side of the respective flow. The supply pockets 6*a* and 8*a* are blind pockets which are subjected to pressure from the sub-vane regions 14 as the latter pass over them, thus ensuring a certain drop in pressure in the sub-vane regions 14 before the vanes 12 enter the rotational angular region of the next flow in each case.

In their pre-assembled state, the components of the vane pump are loosely joined to each other, such that the pre-assembled vane pump can be assembled, i.e. positioned and fastened, as an assembly unit at a desired installation location. The circumferential wall 3 and the end-facing walls 1 and 2 are held together in an axial layered assemblage. The end-facing walls 1 and 2 of the housing each rest against the circumferential wall of the housing 3 in an axial contact. The vane pump can for example be inserted with the first end-facing wall 1 of the housing first into the well of an accommodating structure and fastened to the accommodating structure in the region of the second end-facing wall 2 of the housing. In order to firmly press the housing walls 1, 2 and 3, which are only loosely joined in their pre-assembled state, against each other axially, the vane pump can comprise a spring device 25, for example a disc spring, which when assembled is axially clamped between the pump housing and an abutment on the accommodating structure, for example a base of an accommodating well, and presses the housing walls 1, 2 and 3 axially against each other with a spring force, such that the delivery chamber 4 is closed in a fluid-tight seal, aside from the inlets and outlets 5 to 8, under nominal operating conditions.

The rotor 11 is non-rotationally connected to a drive shaft 15. The drive shaft 15 passes through the second end-facing wall 2 of the housing and the rotor 11 and protrudes into the first end-facing wall 1 of the housing. The drive shaft 15 can in principle also protrude through the first end-facing wall 1 of the housing, but it is more advantageous for the first end-facing wall 1 of the housing to be provided with a blind bore, as in the example embodiment, and for the drive shaft 15 to protrude into this blind bore. A drive portion of the drive shaft 15 protrudes beyond the second end-facing wall 2 of the housing and can be rotary-driven in said drive portion. A drive wheel, for example a belt disc for a belt drive, a sprocket for a chain drive or a toothed wheel for a toothed wheel drive, can be non-rotationally connected to the drive shaft 15 in the drive portion. The passage of the shaft through the end-facing wall 2 of the housing is sealed off by means of a shaft gasket.

The drive shaft 15 is supported radially on one side of the rotor 11 in a rotary bearing on the first end-facing wall 1 of the housing and on the other side of the rotor 11 in a rotary bearing on the second end-facing wall 2 of the housing. The rotary bearings can for example be rotary slide bearings. In order to form the rotary bearing on the first end-facing wall 1 of the housing, a bearing socket 16 can be introduced into the blind bore of the first end-facing wall 1 of the housing, with which the drive shaft 15 is in rotary sliding contact. It would in principle be sufficient for the drive shaft 15 to be supported on one side; the drive shaft 15 is however more advantageously supported on both end-facing side of the rotor 11.

The rotor 11 is non-rotationally seated on the drive shaft 15 and can also be connected axially fixed to the drive shaft 15. The rotor 11 can then, as in the example embodiment, rest against an abutment 17, for example an abutment collar directly on the drive shaft 15, in an axial direction and against another abutment 18 in the opposite axial direction and thus be prevented from moving axially relative to the drive shaft 15. The other abutment 18 can, as in the example embodiment, be formed by a securing ring arranged on the drive shaft 15.

The drive shaft 15 is axially mounted in a suspended manner. The rotating unit consisting of the rotor 11 and the drive shaft 15 is axially mounted relative to the pump housing via the rotor 11. A first end-facing side of the rotor 11 forms a first axial gap with the first end-facing wall 1 of the housing, and the other, second end-facing side of the rotor 11 forms a second axial gap with the second end-facing wall 2 of the housing. The end-facing walls 1 and 2 of the housing form an axial rotary slide bearing with the rotor 11 via the respective axial gap, wherein the axial rotary slide bearing is lubricated by means of the fluid delivered by the vane pump. At least regions of the axial gaps are axially narrow enough that only leakage fluid, driven by pressure differences, is pressed or sucked through the respective axial gap.

In order to improve lubrication and (as in the example embodiment) also to improve how the rotor 11 is axially mounted, a collecting structure 20 which extends around the rotational axis R is formed in the first axial gap. The collecting structure 20 comprises an annular recess which continuously encircles the rotational axis R on the end-facing surface of the first end-facing wall 1 of the housing which faces the rotor 11, i.e. it extends 360° around the rotational axis R and is self-contained. The collecting structure 20 can in particular be formed by one annular recess in the form of an annular groove. The recess can in particular have circumferentially the same profile. In principle, however, the recess can also have a profile which changes in the circumferential direction. The collecting structure 20 can alternatively be formed on the first end-facing side of the rotor, or another collecting structure can additionally be formed on the first end-facing side of the rotor, but it is preferable for a collecting structure to be formed only on the end-facing side of the first end-facing wall 1 of the housing which axially faces the rotor 11.

In the first axial gap, an outer sealing gap which continuously encircles the collecting structure 20 circumferentially without interruption fluidically separates the collecting structure 20 from the supply pockets 5*a*, 6*a*, 7*a* and 8*a* and thus from the sub-vane regions 14 of the rotor 11. The outer sealing gap is axially delineated by an outer sealing surface 1*a* on the end-facing side of the first end-facing wall 1 of the housing and by a sealing surface 11*a* on the end-facing side of the rotor 11. The outer sealing gap 1*a*, 11*a* is configured such that fluid delivered by the vane pump can enter or exit the collecting structure 20 via the outer sealing gap 1*a*, 11*a* in the form of leakage only. The sealing surfaces 1*a* and 11*a*, which face axially opposite each other across the outer sealing gap 1*a*, 11*a*, in particular do not have a channel connecting the collecting structure 20 to one of the supply pockets 5*a* to 8*a* or to another region of the high-pressure side or low-pressure side of the delivery chamber or the vane pump as a whole. Fluid can only flow in the sealing gap 1*a*, 11*a* in accordance with the axial gap width and the surface quality of the sealing surfaces 1*a* and 11*a*.

The first axial gap also comprises an inner sealing gap which fluidically isolates the collecting structure 20 radially inwards, towards the rotational axis R (towards the drive shaft 15 in the example embodiment). The inner sealing gap is axially delineated by an inner sealing surface 1*b* on the end-facing side of the first end-facing wall 1 of the housing and by an inner region of the sealing surface 11*a* on the end-facing side of the rotor 11. The inner sealing gap 1*b*, 11*a* is advantageously configured such that only leakage can occur via this sealing gap 1*b*, 11*a*. In particular, neither the inner sealing surface 1*b* of the first end-facing wall 1 of the housing nor the sealing surface 11*a* of the rotor 11 has a channel through which fluid collected in the collecting structure 20 could flow radially inwards from it. Fluid can only flow in the inner sealing gap 1*b*, 11*a* in accordance with the axial gap width and the surface quality of the sealing surfaces 1*b* and 11*a*.

In the embodiment as an annular groove which has been selected by way of example, the collecting structure 20 is a blind groove.

The rotor 11 can form its sealing surface 11*a* simply by being flat. The first end-facing wall 1 of the housing can simply be flat on its end-facing side which faces the rotor 11, aside from the inlets and outlets 5 to 8 and the supply pockets 5*a* to 8*a*, or at least in the region of its sealing surfaces 1*a* and 1*b*.

The fluid which accumulates in the collecting structure 20 when the vane pump is in operation serves as a lubricant reservoir and thus improves lubrication in the first axial gap. Because the collecting structure 20 is fluidically isolated, the fluid in the collecting structure 20 also forms a sort of hydrostatic bearing for the rotor 11. Fluidically isolating the collecting structure 20 also reduces the fluid losses via the first axial gap and improves the volumetric effectiveness of the vane pump.

In the second axial gap, a collecting structure corresponding to the collecting structure 20 can likewise be provided. This other collecting structure can extend around the rotational axis R, in a comparable way to the collecting structure 20, between the drive shaft 15 and the supply pockets for the sub-vane regions 14 which are optionally also provided on the second end-facing wall 2 of the housing. Of the optionally provided supply pockets of the second end-facing wall 2 of the housing, the supply pockets 6*a* and 8*a* can be seen in the longitudinal section of FIG. 1. Tests have however shown that such an additional collecting structure 20 is not necessary.

Figure 4:
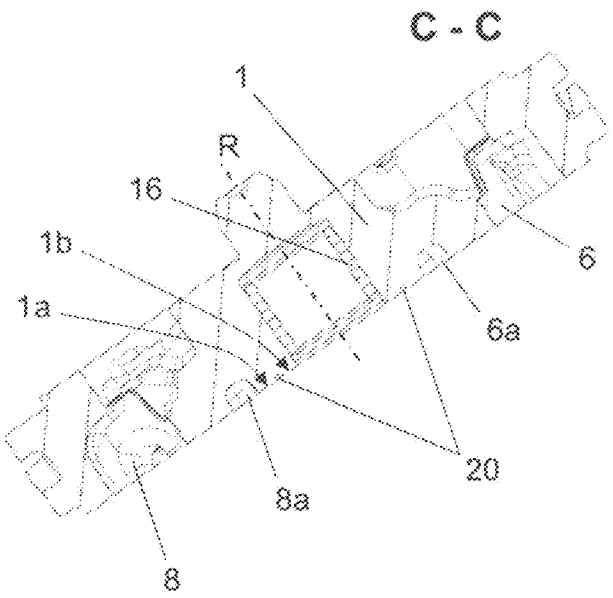
FIG. 4 the end-facing wall of the housing, in the longitudinal section C-C of FIG. 3.
Figure 3:
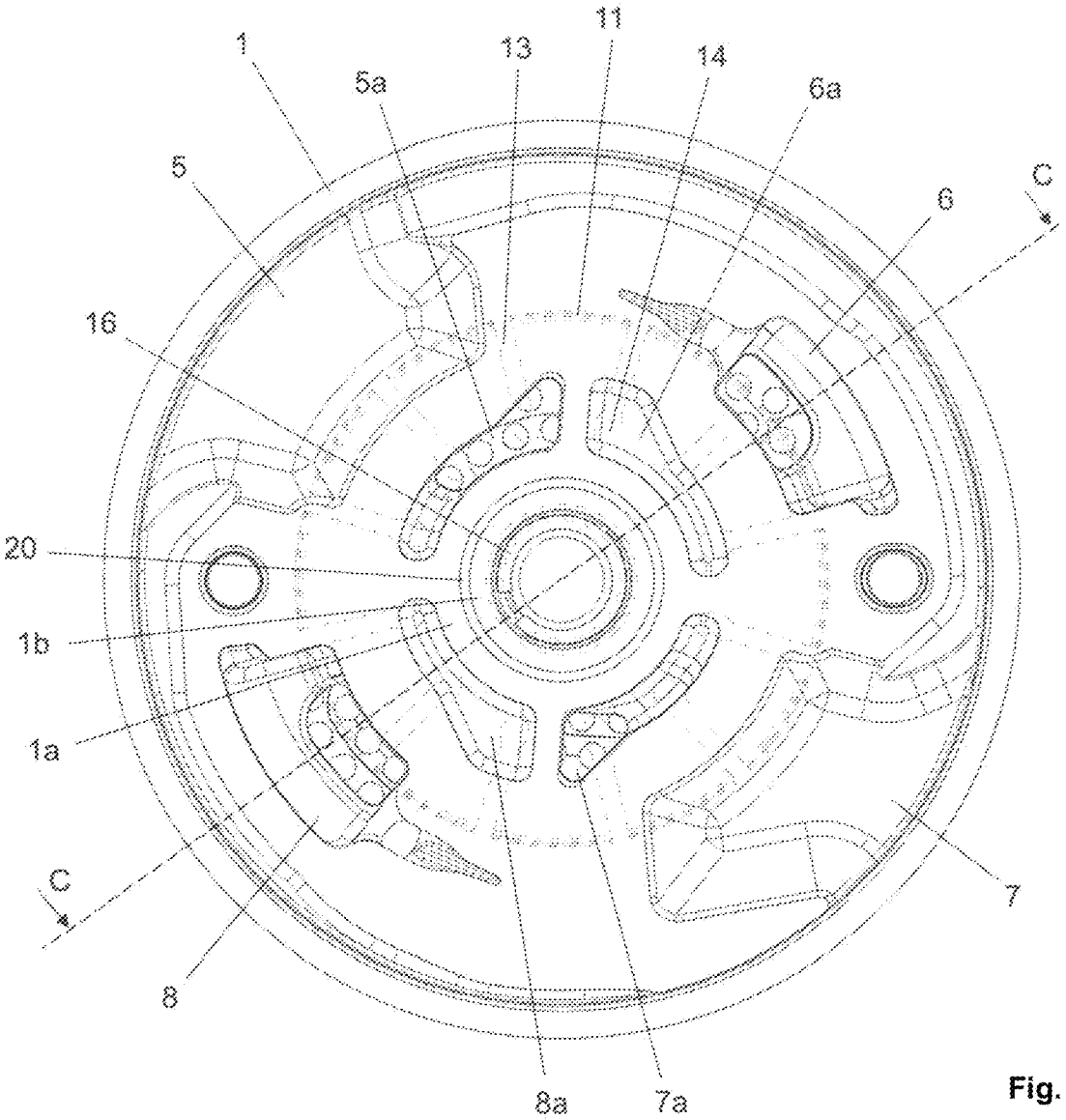
FIG. 3 an end-facing wall of the housing of the vane pump, in a plan view.

FIGS. 3 and 4 show the first end-facing wall 1 of the housing, which in FIG. 3 is shown in a plan view onto the end-facing side which faces the rotor 11 and in FIG. 4 is shown in the longitudinal section C-C of FIG. 3. In the plan view, the rotor 11 is projected onto the end-facing wall 1 of the housing in accordance with its installation location and is indicated together with its guide slots 13 and sub-vane regions 14 in dashed lines. The projection of the rotor 11 indicates in particular the end-facing surface region of the end-facing wall 1 of the housing which the rotor 11 passes over when it is rotated. The collecting structure 20 which is embodied as a blind groove, the outer sealing surface 1*a* which directly adjoins the collecting structure 20 on the radially outer side and the inner sealing surface 1*b* of the first end-facing wall 1 of the housing which likewise directly adjoins the collecting structure 20 on the radially inner side are clearly shown. As already explained, the outer sealing surface 1*a* extends continuously around the collecting structure 20 circumferentially without interruption, between the collecting structure 20 and the supply pockets 5*a*, 6*a*, 7*a* and 8*a* for the sub-vane regions 14 which are located further outwards in the radial direction. The inlets 5 and 7 and the outlets 6 and 8 are formed even further outwards in the radial direction.

Figure 5:
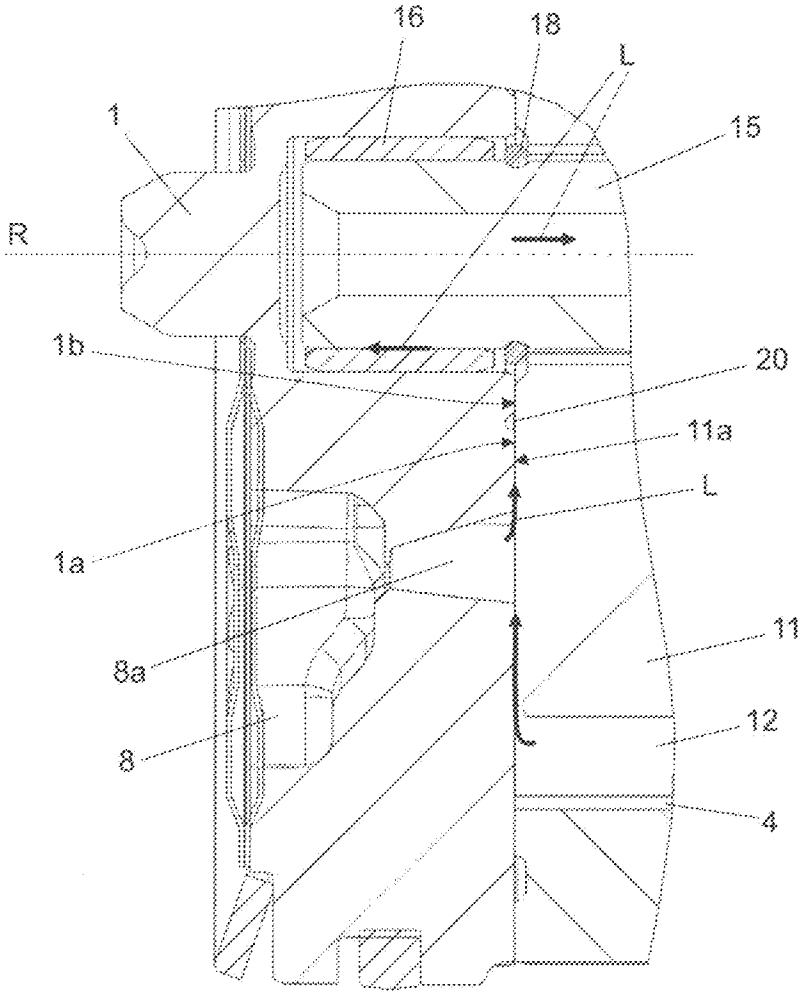
FIG. 5 a portion of the vane pump featuring the collecting structure.

FIG. 5 shows a portion of the first axial gap in the plane of the longitudinal section of FIG. 1. In the portion shown, the supply pocket 8*a* located on the high-pressure side of the second flow opens into the first axial gap. A leakage path L of the fluid delivered by the vane pump is also indicated. In the first axial gap, the leakage path L leads from one of the delivery cells 4 which is just passing through the high-pressure side of the second flow radially inwards towards the supply pocket 8*a*, from the supply pocket 8*a* radially inwards towards the collecting structure 20 through the outer sealing gap 1*a*, 11*a*, and from the collecting structure 20 radially inwards towards the drive shaft 15. In the region of the drive shaft 15, the leakage fluid flows through the rotary slide bearing between the drive shaft 15 and the bearing socket 16 in accordance with the pressure gradient, ensuring hydrodynamic lubrication of the rotary slide bearing 15, 16, and flows off from the rotary slide bearing 15, 16 via the drive shaft 15 which is embodied as a hollow shaft. Within this context, it is also favourable for the shaft receptacle forming the first end-facing wall 1 of the housing for the drive shaft 15 to be a blind bore. This facilitates sealing off the outlets 6 and 8 on the high-pressure side of the vane pump, which is simultaneously also an outer connecting side.

Figure 6:
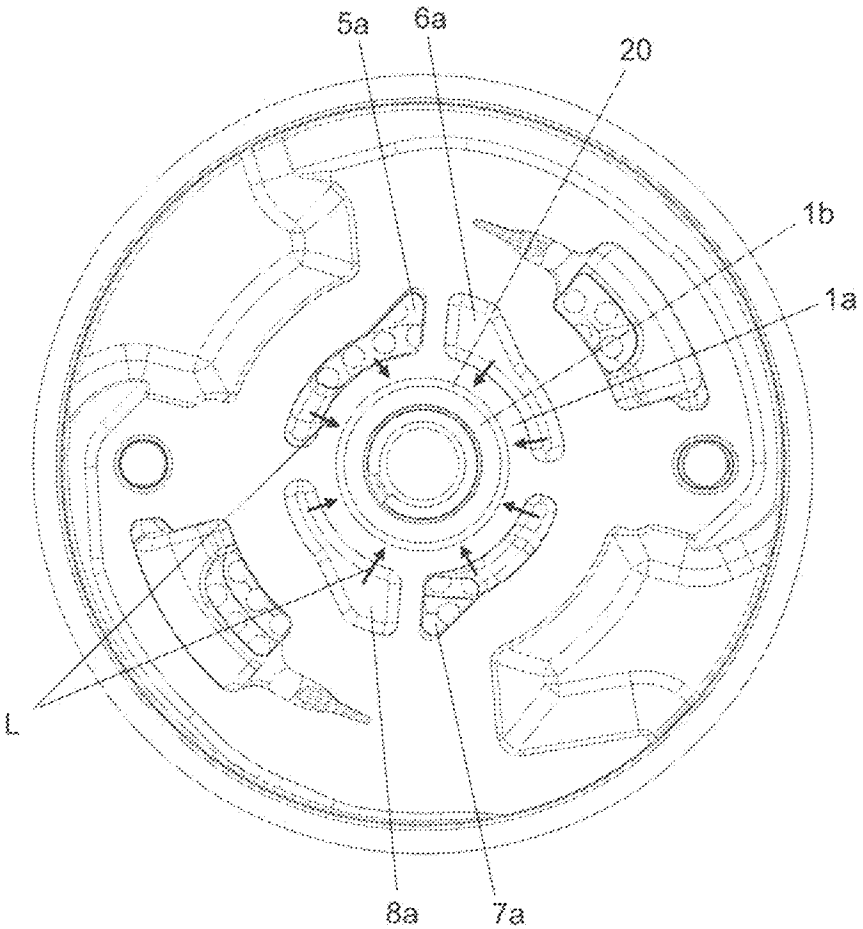
FIG. 6 the end-facing wall of the housing again, in the plan view of FIG. 3.

FIG. 6 shows the first end-facing wall 1 of the housing, again in the same plan view as in FIG. 3, but without the rotor 11. Leakage paths L through the outer sealing gap or over the outer sealing surface 1*a* and through the inner sealing gap or over the inner sealing surface 1*b* are indicated schematically by directional arrows.

Figure 9:
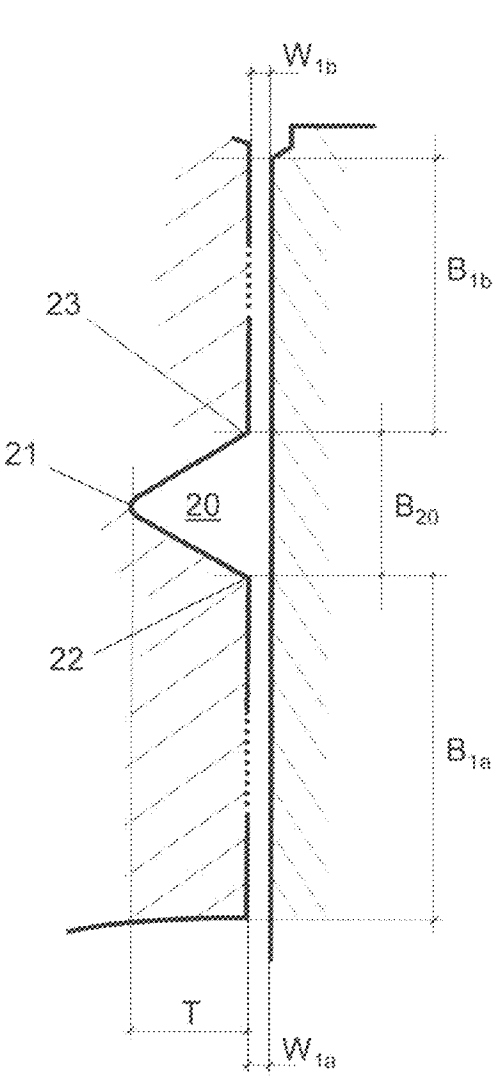
FIG. 9 a collecting structure of a third variant, in a schematic representation.
Figure 8:
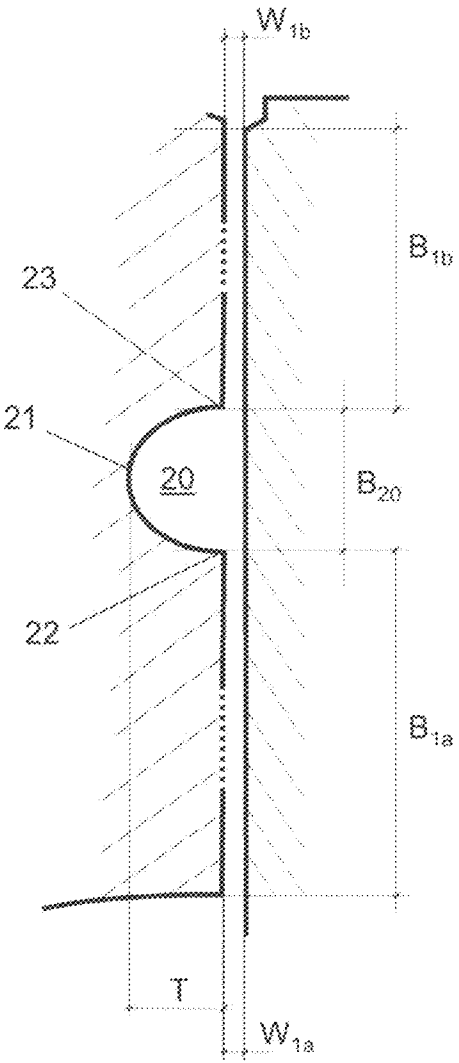
FIG. 8 a collecting structure of a second variant, in a schematic representation.
Figure 7:
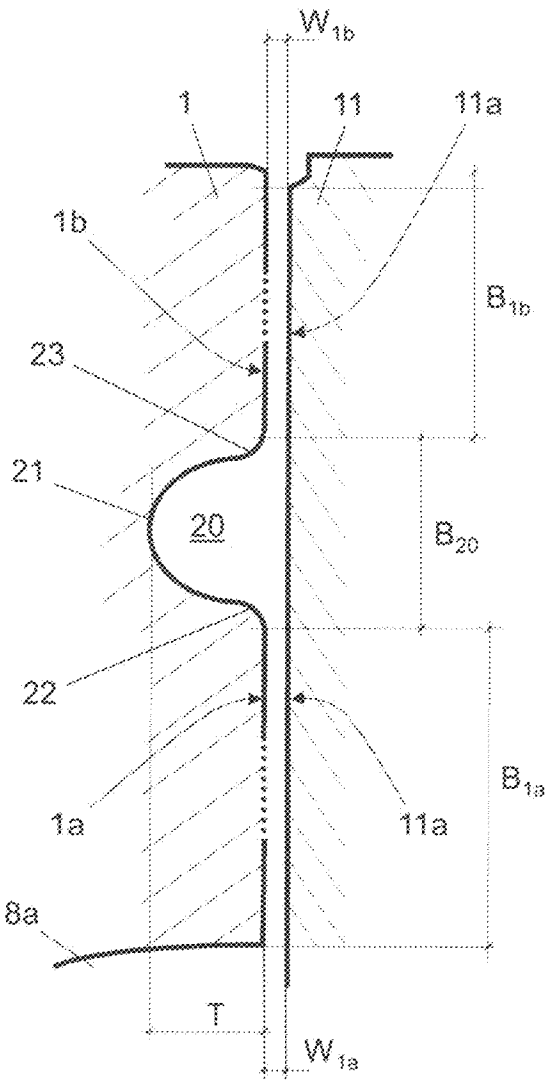
FIG. 7 a collecting structure of a first variant, in a schematic representation.

Each of FIGS. 7, 8 and 9 shows the first axial gap between the end-facing wall 1 of the housing and the rotor 11 in the immediate vicinity of the collecting structure 20. The collecting structure 20 is formed as a continuously circumferential blind groove without interruption, in accordance with the example embodiment, wherein the three collecting structures 20 shown differ from each other in their profile. Aside from the difference in profile, the collecting structure 20 and the first axial gap are otherwise the same in all three variants.

In the first variant shown in FIG. 7, the collecting structure 20 has a round profile comprising a central recess region 21 which is for example shaped as a conical section, for example semicircular, and tapers at the radially outer and/or radially inner edge into the outer sealing surface 1*a* and the inner sealing surface 1*b* via a rounded transition region 22 and 23, respectively.

In the second variant shown in FIG. 8, the collecting structure 20 has the same central recessed region 21 as in the first variant. The second variant differs from the first variant only in that the transition regions 22 and 23 are simply edged or chamfered only obliquely.

In a third variant which is shown in FIG. 9, the collecting structure 20 has a V-shaped profile which in each of the transition regions 22 and 23 simply tapers obliquely into the sealing surfaces 1*a* and 1*b* of the end-facing wall 1 of the housing. A round and in particular V-shaped profile enables the ratio of the opening area to the volume or the ratio of the radial width $B_{20}$ to the cross-sectional area of the profile of the respective collecting structure 20 to be advantageously increased as comparison to for example a U-shaped profile. The opening area is understood to be the area of the collecting structure 20 level with the sealing surfaces 1*a* and 1*b*, i.e. the area between the sealing surfaces 1*a* and 1*b*. If the sealing surfaces 1*a* and 1*b* are to be axially offset with respect to each other, the opening area is understood to be the axial parallel projection of the area between the sealing surfaces 1*a* and 1*b*.

The axial gap width $W_{1a}$ of the outer sealing gap 1*a*, 11*a*, the axial gap width $W_{1b}$ of the inner sealing gap 1*b*, 11*a*, the axial depth T of the respective collecting structure 20, the radial width $B_{1a}$ of the outer sealing gap 1*a*, 11*a*, the radial width $B_{1b}$ of the inner sealing gap 1*b*, 11*a* and the radial width $B_{20}$ of the respective collecting structure 20 (in this case, by way of example, the respective blind groove) are indicated in FIGS. 7 to 9. These variables advantageously meet one or more of the following relationships:

$$T \geq 5 \times W_{1a} \text{ or } T \geq 10 \times W_{1a} \text{ or } T \geq 20 \times W_{1a}$$

$$T \geq 5 \times W_{1b} \text{ or } T \geq 10 \times W_{1b} \text{ or } T \geq 20 \times W_{1b}$$

$$T > 0.2 \text{ mm or } T \geq 0.3 \text{ mm or } T \geq 0.4 \text{ mm}$$

$$T < 1 \text{ mm or } T \leq 0.8 \text{ mm}$$

$$W_{1a} \geq 0.01 \text{ mm}$$

$$W_{1a} \leq 0.05 \text{ mm or } W_{1a} \leq 0.04 \text{ mm or } W_{1a} \leq 0.03 \text{ mm}$$

$$W_{1b} \geq 0.01 \text{ mm}$$

$$W_{1b} \leq 0.05 \text{ mm or } W_{1b} \leq 0.04 \text{ mm or } W_{1b} \leq 0.03 \text{ mm}$$

$$0.5 \leq B_{20}/T \leq 2$$

$$B_{1a} \geq T \text{ or } B_{1a} \geq 2 \times T \text{ or } B_{1a} \geq 3 \times T$$

$$B_{1b} \geq T \text{ or } B_{1b} \geq 2 \times T \text{ or } B_{1b} \geq 3 \times T$$

$$B_{1a} \geq B_{20} \text{ or } B_{1a} \geq 2 \times B_{20} \text{ or } B_{1a} \geq 3 \times B_{20}$$

$$B_{1b} \geq B_{20} \text{ or } B_{1b} \geq 2 \times B_{20} \text{ or } B_{1b} \geq 3 \times B_{20}$$

$$B_{20} \geq 5 \times W_{1a} \text{ or } B_{20} \geq 10 \times W_{1a} \text{ or } B_{20} \geq 20 \times W_{1a}$$

$$B_{20} \geq 5 \times W_{1b} \text{ or } B_{20} \geq 10 \times W_{1b} \text{ or } B_{20} \geq 20 \times W_{1b}$$

$$B_{1a} \geq 1 \text{ mm or } B_{1a} \geq 1.5 \text{ mm or } B_{1a} \geq 2 \text{ mm}$$

$$B_{1b} \geq 1 \text{ mm or } B_{1b} \geq 1.5 \text{ mm or } B_{1b} \geq 2 \text{ mm.}$$

The outer sealing surface 1*a* and/or the inner sealing surface 1*b* of the first end-facing wall 1 of the housing can in particular be obtained by lapping. With regard to the surface quality, the outer sealing surface 1*a* and/or the inner sealing surface 1*b* can for example have an average surface roughness of Rz3 and/or a relative material ratio Rmr(1.0)>75% (c0 5%). It is advantageous for the reduced peak height Rpk of the outer sealing surface 1*a* and/or inner sealing surface 1*b* to be less than 0.4 μm and/or for the core surface roughness Rk of the outer sealing surface 1*a* and/or inner sealing surface 1*b* to be less than 1.5 μm. The sealing surface 11*a* of the rotor 11 should have an average surface roughness of Rz7 or less.

REFERENCE SIGNS

1 end-facing wall of the housing
1*a* sealing surface, sealing stay of the end-facing wall
1*b* sealing surface, sealing stay of the end-facing wall
2 end-facing wall of the housing
3 circumferential wall of the housing
4 delivery chamber
5 inlet
5*a* supply pocket
6 outlet 45
6*a* supply pocket
7 inlet
7*a* supply pocket
8 outlet
8*a* supply pocket
9 —
10 impeller
11 rotor
11*a* sealing surface, sealing stay of the rotor
12 vane
13 guide slot
14 sub-vane region
15 drive shaft
16 bearing socket
17 abutment
18 abutment
19 —
20 collecting structure
21 central recess region
22 transition
23 transition
24 axial gasket
25 spring device
$B_{1a}$ radial width
$B_{1b}$ radial width
$B_{20}$ radial width
L leakage path
R rotational axis
T depth
W axial width

The invention claimed is:

1. A vane pump for supplying an assembly with a fluid, the vane pump comprising:

a pump housing having a first end-facing wall and a second end-facing wall which delineate a delivery chamber of the vane pump on one end-facing side each, and a circumferential wall which extends around the delivery chamber;

an inlet for the fluid on a low-pressure side of the delivery chamber and an outlet for the fluid on a high-pressure side of the delivery chamber;

a rotor which can be rotated about a rotational axis in the delivery chamber, and which forms a first axial gap with the first end-facing wall of the housing on a first end-facing side and a second axial gap with the second end-facing wall of the housing on the other, second end-facing side;

multiple vanes which can be moved back and forth in guide slots of the rotor, wherein the guide slots have radially inner sub-vane regions which are connected to the high-pressure side of the delivery chamber at least when the vanes are passing through the high-pressure side, in order to apply pressure to the underside of the respective vanes; and a collecting structure which extends around the rotational axis in the first axial gap in order to collect fluid which enters the collecting structure via the first axial gap, wherein the collecting structure comprises one or more recesses formed on the first end-facing wall of the housing and/or the first end-facing side of the rotor, radially between the rotational axis and the sub-vane regions, and the first axial gap forms an outer sealing gap, radially between the sub-vane regions and the collecting structure, which continuously encircles the rotational axis without interruption.

2. The vane pump according to claim 1, wherein the first axial gap forms an inner sealing gap, circumferentially and continuously around the rotational axis without interruption, which the collecting structure surrounds.

3. The vane pump according to claim 1, wherein the collecting structure is a blind groove.

4. The vane pump according to claim 1, wherein the collecting structure is fluidically isolated such that fluid can only enter the collecting structure via leakage.

5. The vane pump according to claim 1, wherein the outer sealing gap and/or the inner sealing gap, if provided, fluidically separates the collecting structure from the high-pressure side and/or the low-pressure side of the vane pump, such that fluid can only enter and/or exit the collecting structure due to leakage via the respective sealing gap.

6. The vane pump according to claim 1, wherein the collecting structure is continuously circumferential.

7. The vane pump according to claim 1, wherein the outer sealing gap has an axial width $W_{1a}$ and/or the inner sealing gap, if provided, has an axial width $W_{1b}$, the collecting structure has a maximum axial depth T, and one or more of the following relationships is/are met:

$$T \geq 5 \times W_{1a} \text{ or } T \geq 10 \times W_{1a} \text{ or } T \geq 20 \times W_{1a}$$

and/or $$T \geq 5 \times W_{1b} \text{ or } T \geq 10 \times W_{1b} \text{ or } T \geq 20 \times W_{1b}.$$

8. The vane pump according to claim 1, wherein the outer sealing gap has a radial width $B_{1a}$ and/or the inner sealing gap, if provided, has a radial width $B_{1b}$, the collecting structure has a maximum axial depth T, and one or more of the following relationships is/are met:

$$B_{1a} \geq T \text{ or } B_{1a} \geq 2 \times T \text{ or } B_{1a} \geq 3 \times T$$

and/or $$B_{1b} \geq T \text{ or } B_{1b} \geq 2 \times T \text{ or } B_{1b} \geq 3 \times T.$$

9. The vane pump according to claim 1, wherein:

the first end-facing wall of the housing has a radially outer sealing surface and a radially inner sealing surface;

the first end-facing side of the rotor has a radially outer sealing surface and a radially inner sealing surface;

the outer sealing surface of the end-facing wall and the outer sealing surface of the rotor continuously encircle the rotational axis without interruption axially opposite each other and form the outer sealing gap which is circumferentially contained over 360° and surrounds the collecting structure; and the inner sealing surface of the end-facing wall and the inner sealing surface of the rotor continuously encircle the rotational axis without interruption axially opposite each other and form an inner sealing gap which is circumferentially contained over 360° and which the collecting structure surrounds.

10. The vane pump according to claim 9, wherein the outer sealing gap surrounds and radially adjoins the collecting structure.

11. The vane pump according to claim 9, wherein the inner sealing gap radially adjoins the collecting structure.

12. The vane pump according to claim 1, wherein the respective recess of the collecting structure has a round or U-shaped or V-shaped profile.

13. The vane pump according to claim 1, wherein the rotor is axially mounted in a suspended manner between the first end-facing wall of the housing and the second end-facing wall of the housing.

14. The vane pump according to claim 1, comprising a drive shaft which is mounted such that it can be rotated about the rotational axis and to which the rotor is connected in a way which transmits torque, wherein the collecting structure extends around the drive shaft, and the first axial gap forms an inner sealing gap which encircles the drive shaft, radially between the rotational axis and the collecting structure, continuously without interruption.

15. The vane pump according to claim 14, wherein the drive shaft protrudes into the first end-facing wall of the housing, and the inner sealing gap adjoins the drive shaft on the radially inner side and the collecting structure on the radially outer side.

16. The vane pump according to claim 1, wherein the vane pump has a first flow comprising the inlet and the outlet and, following the first flow in the rotational direction of the rotor, a second flow comprising another inlet and another outlet, such that when the rotor is rotated, a portion of the fluid is delivered in the first flow and another portion of the fluid is delivered in the second flow.

17. The vane pump according to claim 1, wherein one or more supply pockets which open into the first axial gap and are connected to the high-pressure side or the low-pressure side of the vane pump is/are provided on the first end-facing wall of the housing, axially facing the sub-vane regions, and the outer sealing gap continuously encircles the rotational axis, radially between the collecting structure and the supply pocket(s).

18. The vane pump according to claim 1, wherein the collecting structure is a blind groove which encircles the rotational axis continuously.

19. The vane pump according to claim 1, wherein the collecting structure is fluidically isolated such that fluid can only enter the collecting structure via leakage and also only exit the collecting structure via leakage.

20. The vane pump according to claim 1, wherein the collecting structure is continuously circumferential and is or comprises an annular groove which continuously encircles the rotational axis.

* * * * *